US009183818B2

(12) United States Patent
Defayette

(10) Patent No.: US 9,183,818 B2
(45) Date of Patent: Nov. 10, 2015

(54) MUSICAL INSTRUMENT LASER TRACKING DEVICE

(71) Applicant: Normand Defayette, Lachine (CA)

(72) Inventor: Normand Defayette, Lachine (CA)

( * ) Notice: Subject to any disclaimer, the term of this patent is extended or adjusted under 35 U.S.C. 154(b) by 86 days.

(21) Appl. No.: 14/102,491

(22) Filed: Dec. 10, 2013

(65) Prior Publication Data

US 2015/0161976 A1 Jun. 11, 2015

(51) Int. Cl.

| | |
|---|---|
| ***G10H 7/00*** | (2006.01) |
| ***A63J 17/00*** | (2006.01) |
| ***A63J 5/10*** | (2006.01) |
| ***G10H 1/00*** | (2006.01) |
| ***G10G 7/00*** | (2006.01) |

(52) U.S. Cl.
CPC ... *G10G 7/00* (2013.01); *G10H 1/00* (2013.01)

(58) Field of Classification Search
CPC ..... G10H 2220/421; G10H 1/00; G10G 7/00
USPC ..... 84/464 R, 464 A, 645
See application file for complete search history.

(56) References Cited

U.S. PATENT DOCUMENTS

| | | | | |
|---|---|---|---|---|
| 3,744,366 | A | 7/1973 | Castillo | |
| 4,322,997 | A | 4/1982 | Anstis | |
| 4,516,465 | A | 5/1985 | Kani | |
| 5,017,770 | A * | 5/1991 | Sigalov | 250/221 |
| 5,266,735 | A | 11/1993 | Shaffer et al. | |
| 5,280,742 | A | 1/1994 | Vergara | |
| 5,394,784 | A | 3/1995 | Pierce et al. | |
| 5,475,214 | A * | 12/1995 | DeFranco et al. | 250/221 |
| 5,739,457 | A | 4/1998 | Devecka | |
| 5,986,201 | A | 11/1999 | Starr et al. | |
| 6,225,544 | B1 * | 5/2001 | Sciortino | 84/464 A |
| 6,417,439 | B2 | 7/2002 | Uehara et al. | |
| 7,071,404 | B1 * | 7/2006 | Smith | 84/724 |
| 7,227,075 | B2 | 6/2007 | Chung et al. | |
| 7,323,633 | B2 | 1/2008 | Shaffer | |
| 7,809,448 | B2 * | 10/2010 | Lys et al. | 700/12 |
| 8,445,771 | B2 * | 5/2013 | Sakazaki | 84/743 |
| 2005/0275626 | A1 * | 12/2005 | Mueller et al. | 345/156 |
| 2006/0075879 | A1 * | 4/2006 | Ushinski | 84/464 A |
| 2006/0174756 | A1 | 8/2006 | Pangrie | |
| 2010/0011942 | A1 * | 1/2010 | Wessels | 84/724 |

FOREIGN PATENT DOCUMENTS

| | | |
|---|---|---|
| WO | WO2006116685 | 11/2006 |
| WO | WO2009136343 | 11/2009 |

* cited by examiner

*Primary Examiner* — Jeffrey Donels

(57) ABSTRACT

A musical instrument laser tracking device comprises a musical instrument digital interface adapted to be connected to a musical instrument digital interface port of a musical instrument. A computer system electronically connected to the musical instrument digital interface and incorporating software adapted to produce electronic signals to control a laser projector. A digital-to-analog converter electronically connected to the computer system and adapted to convert the electronic signals from a digital format to an analog format, and a laser projector electronically connected to the digital-to-analog converter and adapted to receive the electronic analog signals from the digital-to-analog converter, generate laser beams accordingly, and shine the laser beams on predetermined objects in predetermined patterns.

15 Claims, 5 Drawing Sheets

24

MUSICAL INSTRUMENT LASER TRACKING DEVICE

This application claims priority based on request GB1222295.6 filed Dec. 11, 2012

FIELD OF THE INVENTION

The present invention relates generally to synchronous lights for music but more particularly to a musical instrument laser tracking device.

BACKGROUND OF THE INVENTION

There currently exist laser shows and music shows which combine lights and lasers synchronized to music to enhance the experience of the audience. Besides an auditory experience, they add a visual aspect that thrills the audience. In a music show or the opening and closing ceremonies of the Olympics for example. In a live music show we have lights and lasers linked to the overall music and/or the beat or drums but none that links the audience to any particular instrument player as they play each individual note or beat. Similarly when a musician is practicing alone and would like an enhanced visual effect to every note that is played, there currently exists no such solution. There currently exists a need for a device that enhances the experience of both a single live instrument player alone and together with an audience

SUMMARY OF THE INVENTION

In view of the foregoing disadvantages inherent in the known devices now present in the prior art, the present invention, which will be described subsequently in greater detail, is to provide objects and advantages which are:

To provide for a device which enhances the experience of a live instrument player with the use of lasers.

In order to do so, the invention comprises a musical instrument digital interface adapted to be connected to a musical instrument digital interface port of a musical instrument. A computer system electronically connected to the musical instrument digital interface and incorporating software adapted to produce electronic signals to control a laser projector. A digital-to-analog converter electronically connected to the computer system and adapted to convert the electronic signals from a digital format to an analog format, and a laser projector electronically connected to the digital-to-analog converter and adapted to receive the electronic analog signals from the digital-to-analog converter, generate laser beams accordingly, and shine the laser beams on predetermined objects in predetermined patterns.

The laser projector is adapted to generate a plurality of laser beams of differing colors, differing intensities, differing movements, and differing projected patterns.

The laser projector includes at least one galvanometer and at least one mirror adapted to shape and deviate the laser beams generated by the laser projector. The at least one mirror is formed having a shape chosen from a list of shapes comprising flat, concave, and convex.

The computer system software is adapted to compute geometric coordinates for a note being played by the musical instrument to thereby direct a laser beam from the laser projector at a chosen location a distance from the laser projector.

The computer system software is further adapted to compute a plurality of geometric coordinates for respective plurality of notes being played by the musical instrument to thereby direct laser beams from the laser projector at a chosen location a distance from the laser projector for each the plurality of notes.

The computer software is also adapted to individually modulate the colors and intensities of each of the plurality of laser beams.

In combination with a musical instrument, the laser display system comprises a musical instrument having a musical instrument digital interface port. A musical instrument digital interface connected to the musical instrument digital interface port of the musical instrument. A computer system electronically connected to the musical instrument digital interface and incorporating software adapted to produce electronic signals to control a laser projector. A digital-to-analog converter electronically connected to the computer system and adapted to convert the electronic signals from a digital format to an analog format, and a laser projector electronically connected to the digital-to-analog converter and adapted to receive the electronic analog signals from the digital-to-analog converter, generate laser beams accordingly, and shine the laser beams on predetermined objects in predetermined patterns.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
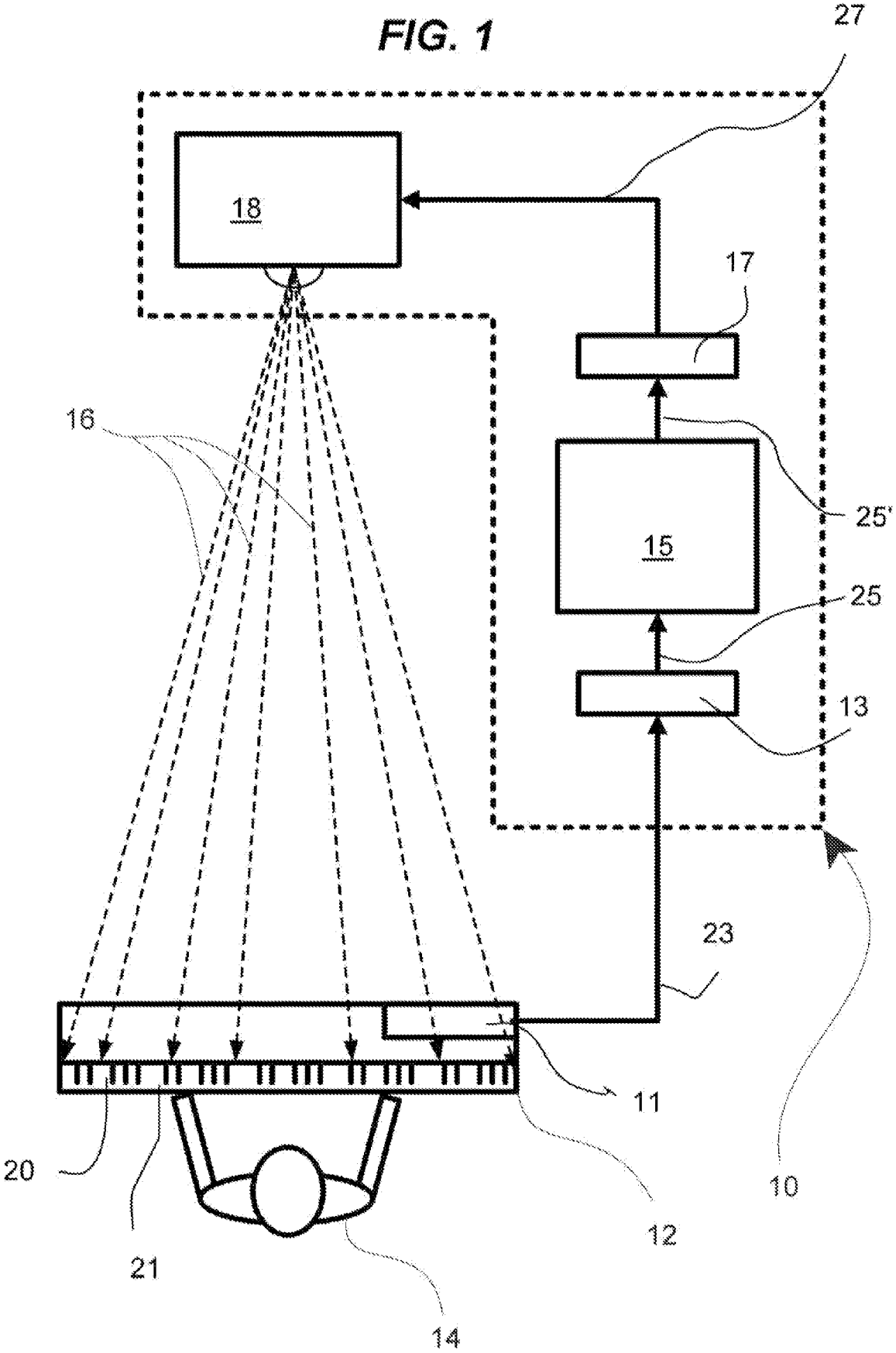
FIG. 1 Schematic views of the invention.
Figure 2:
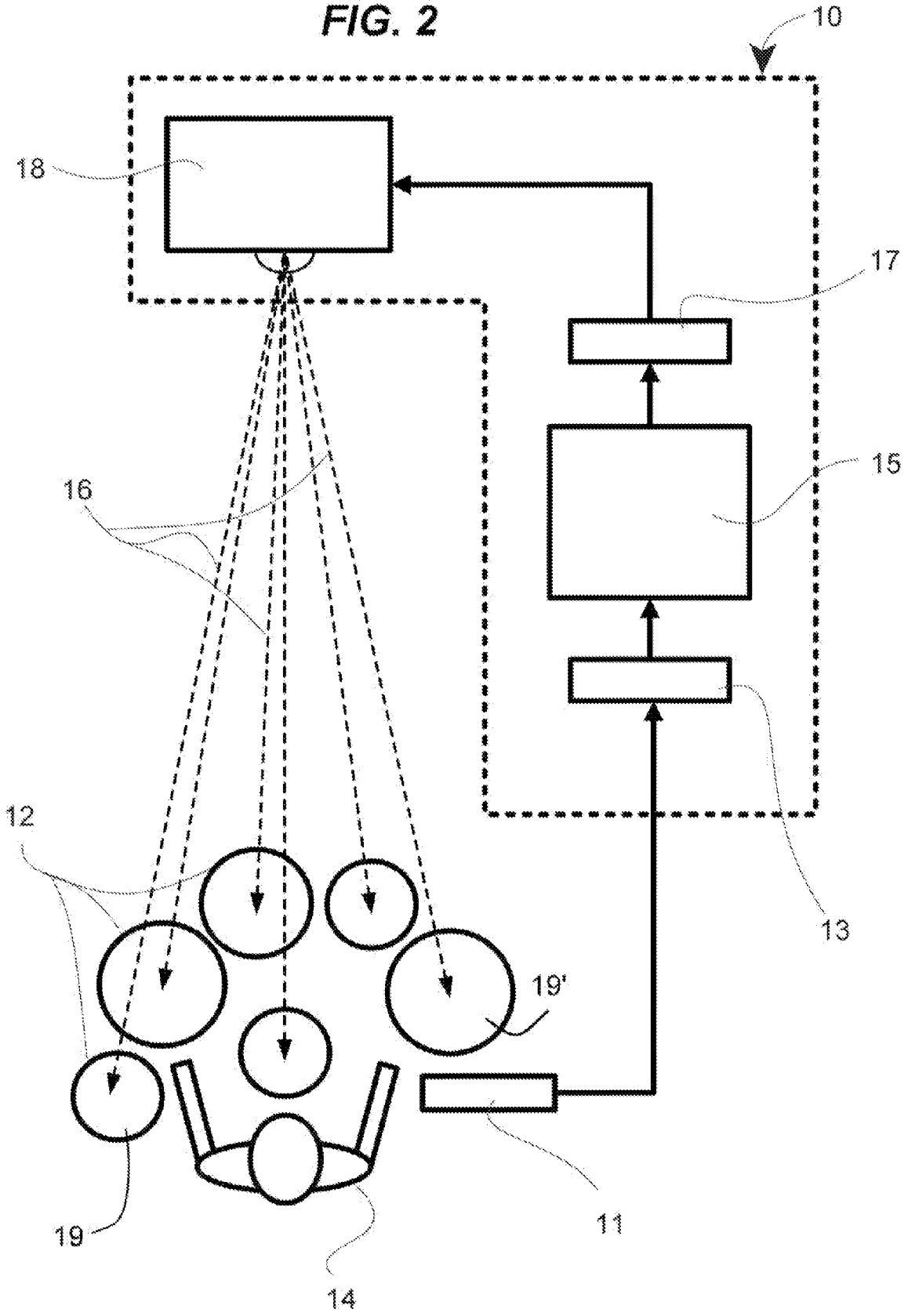
FIG. 2 Schematic views of the invention with an alternate instrument.

A musical instrument laser tracking device (10) comprising a MIDI interface (13), a computer system (15) with customized software (not shown), a DAC interface (17) and a laser projector (18).

A musical instrument (12) with a MIDI port (11) is connected to the musical instrument laser tracking device (10) by way of a MIDI cable (23) such that when a key (21) on a keyboard (20) is depressed or a drum (19) or cymbal (19') is hit, a laser beam (16) from the laser projector (18) is sent to that same key (21) or same drum (19).

The musical instrument laser tracking device (10) converts a digital signal output (not shown) from the MIDI out (11) of the musical instrument (12) into an analogue voltage signal (not shown) using the DAC interface (17) and the computer system (15) to direct the laser projector (18) to send a beam (16) to the key (not shown) or drum (19) of the musical instrument (12) that is being played.

From the MIDI out (11), the digital signal output goes through a MIDI cable (23), into the MIDI interface (13) then through a digital cable (25) through the computer system (15), then through another digital cable (25'), through the DAC interface (17), and then, by way of an analog cable (27) into the projector (18).

Figure 3A:
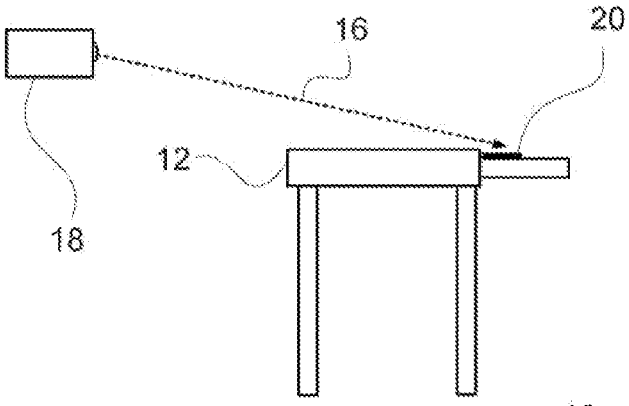
FIGS. 3*a-d* Side views showing various ways the laser light can interact with the musical instrument.
Figure 3B:
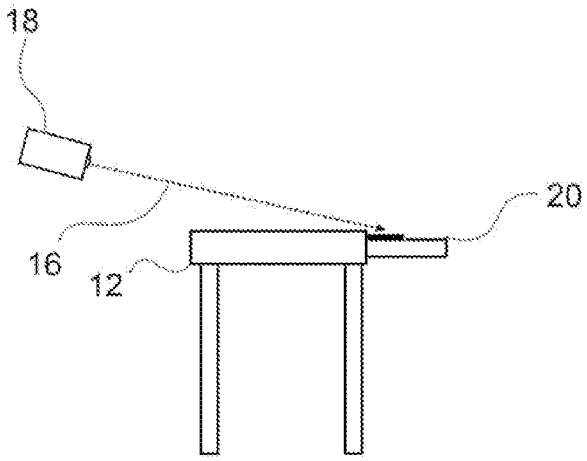
Figure 3C:
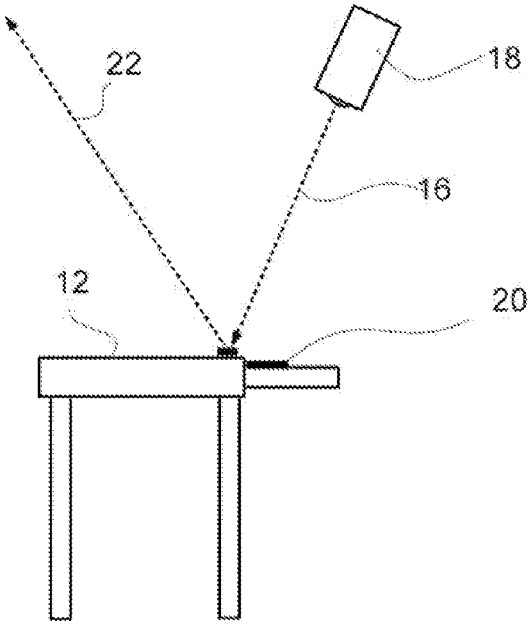
Figure 3D:
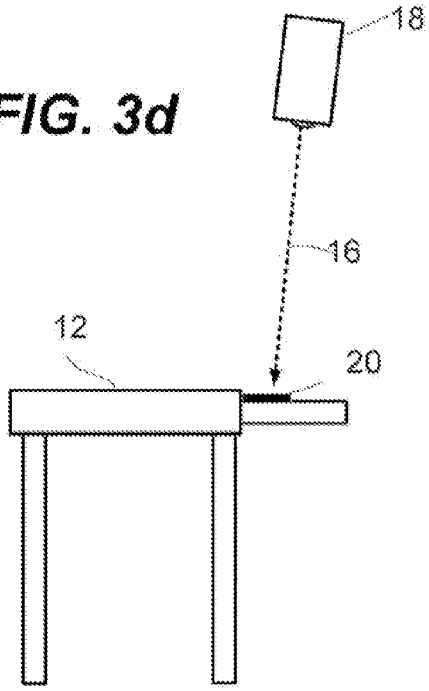
Figure 4A:
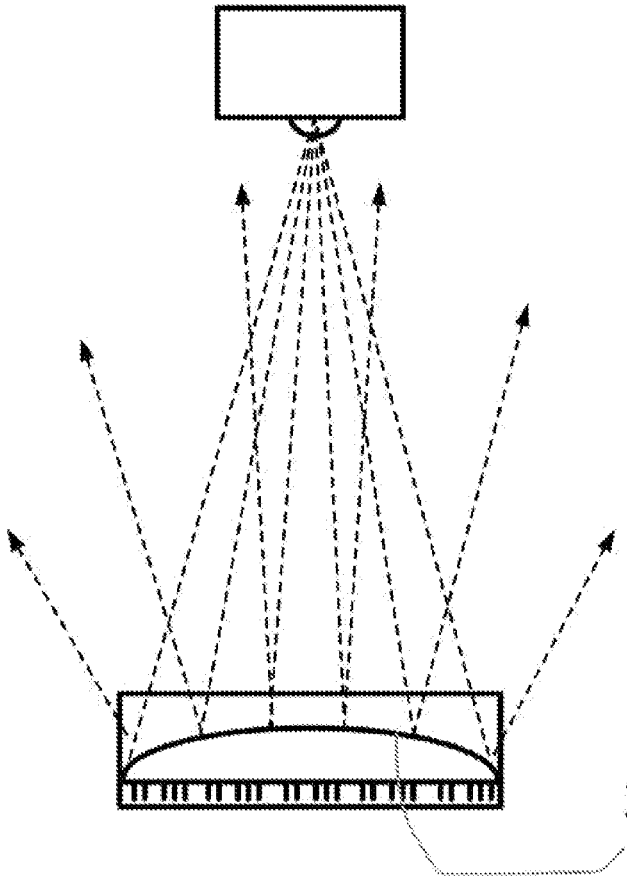
FIGS. 4*a-b* Top view showing use of convex and concave mirrors.
Figure 4B:
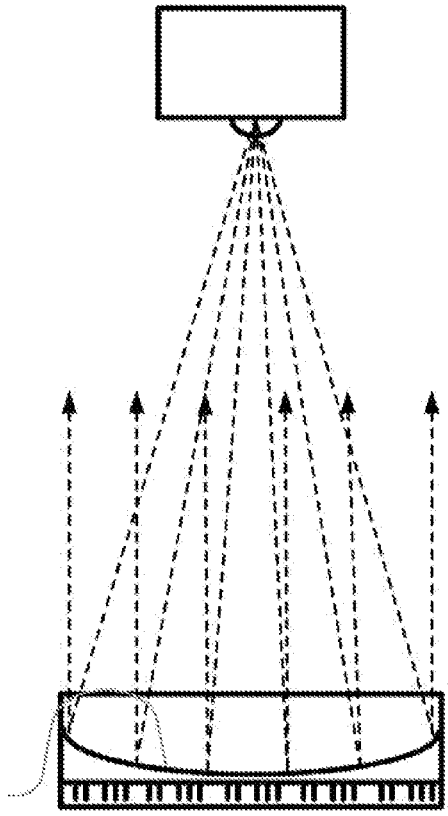
Figure 5:
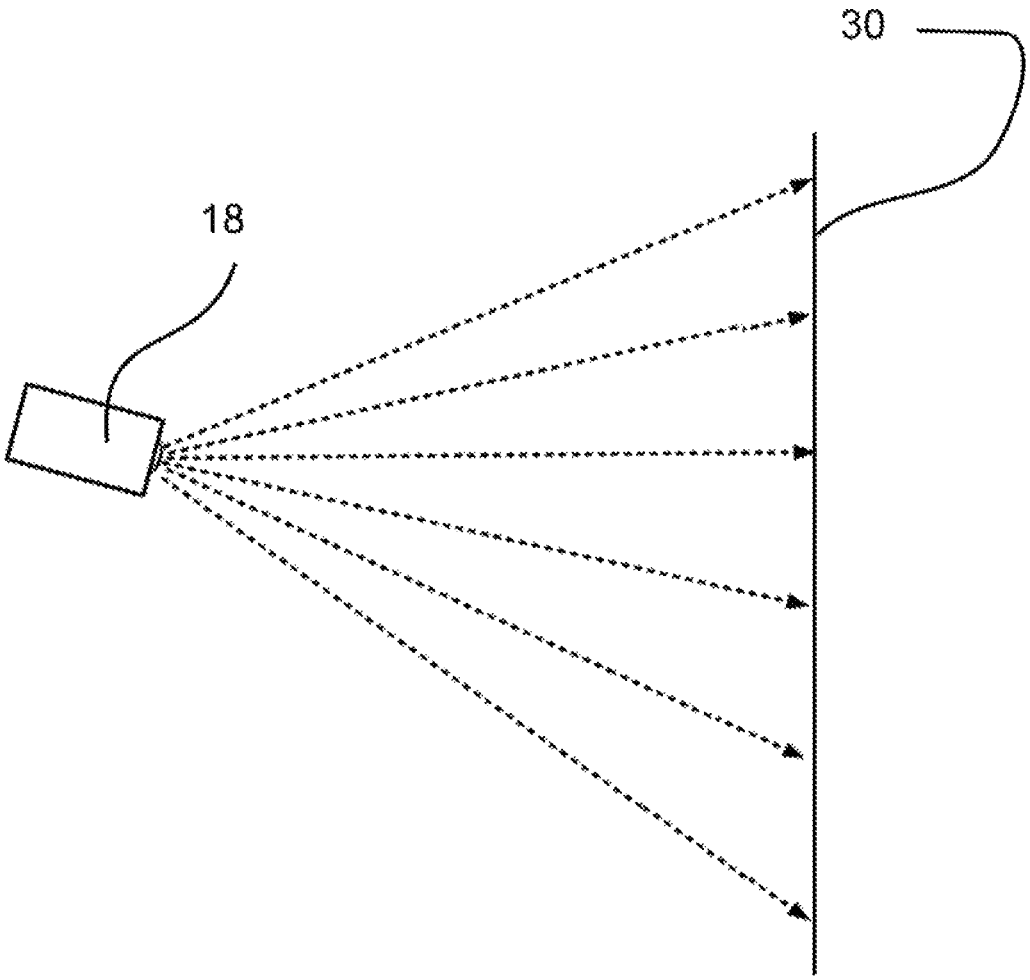
FIG. 5 Schematic view showing a projector shining light on a screen.

The position of the laser projector (18) relative to the instrument (12) can be varied as seen in FIGS. 3 *a, b* and *c* to obtain different effects. Similarly the use of a mirror (24), flat, concave or convex can be introduced to further vary the effects of the incident laser beams (18) and the reflected beams (22). Also, the laser projector (18) can aim at a white screen (not shown) where a realistic or abstract vector representation of a piano keyboard is displayed showing the notes being played in real time. A typical location of such a screen would be behind and above the player, where the audience can see the matching movements.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A laser tracking device for musical instruments, comprising a musical instrument digital interface adapted to be connected to a musical instrument digital interface port of a musical instrument: a computer system electronically connected to said musical instrument digital interface and incorporating software adapted to produce electronic signals to control a laser projector; a digital-to-analog converter electronically connected to said computer system and adapted to convert said electronic signals from a digital format to an analog format; and a laser projector electronically connected to said digital-to-analog converter and adapted to receive said electronic analog signals from said digital-to-analog converter, generate laser beams accordingly, and shine said laser beams on predetermined objects in predetermined patterns; said laser projector is adapted to generate a plurality of laser beams of differing colors, differing intensities, differing movements, and differing projected patterns; said laser projector includes at least one galvanometer and at least one mirror adapted to shape and deviate said laser beams generated by said laser projector.

2. The laser tracking device of claim 1, wherein said at least one mirror is formed having a shape chosen from a list of shapes comprising flat, concave, and convex.

3. The laser tracking device of claim 1, wherein said computer system software is adapted to compute geometric coordinates for a note being played by said musical instrument to thereby direct a laser beam from said laser projector at a chosen location a distance from said laser projector.

4. The laser tracking device of claim 3, wherein said computer system software is adapted to compute a plurality of geometric coordinates for respective plurality of notes being played by said musical instrument to thereby direct laser beams from said laser projector at a chosen location a distance from said laser projector for each said plurality of notes.

5. The laser tracking device of claim 1, wherein said computer software is adapted to individually modulate said colors and intensities of each said plurality of laser beams.

6. A musical instrument and laser display system comprising a musical instrument having a musical instrument digital interface port; and a musical instrument digital interface connected to said musical instrument digital interface port of said musical instrument; a computer system electronically connected to said musical instrument digital interface and incorporating software adapted to produce electronic signals to control a laser projector; a digital-to-analog converter electronically connected to said computer system and adapted to convert said electronic signals from a digital format to an analog format; and a laser projector electronically connected to said digital-to-analog converter and adapted to receive said electronic analog signals from said digital-to-analog converter, generate laser beams accordingly, and shine said laser beams on predetermined objects in predetermined patterns; said laser projector is adapted to generate a plurality of laser beams of differing colors, differing intensities, differing movements, and differing projected patterns; said laser projector includes at least one galvanometer and at least one mirror adapted to shape and deviate said laser beams generated by said laser projector.

7. The laser tracking device of claim 6, wherein said at least one mirror is formed having a shape chosen from a list of shapes comprising flat, concave, and convex.

8. The laser tracking device of claim 6, wherein said computer system software is adapted to compute geometric coordinates for a note being played by said musical instrument to thereby direct a laser beam from said laser projector at a chosen location a distance from said laser projector.

9. The laser tracking device of claim 8, wherein said computer system software is adapted to compute a plurality of geometric coordinates for respective plurality of notes being played by said musical instrument to thereby direct laser beams from said laser projector at a chosen location a distance from said laser projector for each said plurality of notes.

10. The laser tracking device of claim 6, wherein said computer software is adapted to individually modulate said colors and intensities of each said plurality of laser beams.

11. The laser tracking device of claim 6, wherein said musical instrument is a keyboard; and wherein chosen laser beams are directed to shine on respective keys of said keyboard when a particular note is played by said keyboard.

12. The laser tracking device of claim 11, wherein said keyboard includes a mirror upon a surface adjacent said keys and adapted to reflect said laser beams away therefrom in a chosen array.

13. The laser tracking device of claim 12, wherein said mirror is in a shape chosen from a list of shapes comprising concave and convex.

14. The laser tracking device of claim 6, wherein said musical instrument is a drum kit including a plurality of drums and cymbals; and wherein chosen laser beams are directed to shine on respective drums and cymbals of said drum kit when a particular drum or cymbal is hit by a drummer; and wherein said laser beams are shone in patterns adapted to create vibrating circles upon the surfaces of respective drums and cymbals when hit by said drummer.

15. The laser tracking device of claim 6, wherein said predetermined objects includes a white screen located such that said laser beams can be directed thereon in a chosen pattern, and thereby adapted to create an effect visible to an audience assembled to watch a performer play said instrument.

* * * * *